US010589520B2

(12) United States Patent
Oikawa et al.

(10) Patent No.: US 10,589,520 B2
(45) Date of Patent: Mar. 17, 2020

(54) LIQUID EJECTION HEAD AND LIQUID EJECTION APPARATUS

(71) Applicant: CANON KABUSHIKI KAISHA, Tokyo (JP)

(72) Inventors: Satoshi Oikawa, Yokohama (JP); Shingo Okushima, Kawasaki (JP); Satoshi Kimura, Kawasaki (JP); Kengo Umeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/031,359

(22) Filed: Jul. 10, 2018

(65) Prior Publication Data

US 2019/0016119 A1 Jan. 17, 2019

(30) Foreign Application Priority Data

Jul. 13, 2017 (JP) ..... 2017-137266

(51) Int. Cl.

| | |
|---|---|
| ***B41J 2/045*** | (2006.01) |
| ***B41J 2/175*** | (2006.01) |
| ***B41J 2/005*** | (2006.01) |
| ***B41J 2/14*** | (2006.01) |
| *B41J 2/01* | (2006.01) |

(52) U.S. Cl.

CPC ..... *B41J 2/0451* (2013.01); *B41J 2/0057* (2013.01); *B41J 2/04581* (2013.01); *B41J 2/14072* (2013.01); *B41J 2/14153* (2013.01); *B41J 2/175* (2013.01); *B41J 2002/012* (2013.01); *B41J 2002/14491* (2013.01); *B41J 2202/20* (2013.01); *B41J 2202/21* (2013.01)

(58) Field of Classification Search

CPC .... B41J 2/0451; B41J 2/0057; B41J 2/04581; B41J 2/14072; B41J 2/14153

See application file for complete search history.

(56) References Cited

U.S. PATENT DOCUMENTS

| | | | | |
|---|---|---|---|---|
| 2010/0007709 | A1 * | 1/2010 | Utsugi | B41J 29/02 347/108 |
| 2015/0328895 | A1 * | 11/2015 | Kudo | B41J 2/17513 347/54 |
| 2017/0341379 | A1 | 11/2017 | Umeda et al. | |
| 2018/0304623 | A1 | 10/2018 | Okushima et al. | |
| 2018/0333955 | A1 | 11/2018 | Oikawa et al. | |
| 2018/0361739 | A1 | 12/2018 | Umeda et al. | |

FOREIGN PATENT DOCUMENTS

| | | | |
|---|---|---|---|
| JP | 2008-254362 | A | 10/2008 |
| JP | 2008254362 | A2 * | 10/2008 |

* cited by examiner

*Primary Examiner* — Jason S Uhlenhake
(74) *Attorney, Agent, or Firm* — Venable LLP

(57) ABSTRACT

A liquid ejection head includes a recording element substrate which ejects a liquid downward; an electric substrate which is disposed above the recording element substrate, which has a plurality of electric components, including a capacitor, and which is electrically connected to the recording element substrate; a wall which covers the electric substrate such that a liquid can be retained between the wall and the electric substrate; and a sensor which is disposed in an area covered by the wall and which detects for the presence of a liquid. In the attitude of the liquid ejection head as attached to the main unit of a liquid ejection apparatus, the sensor is disposed below the capacitor in a vertical direction.

21 Claims, 9 Drawing Sheets

LIQUID EJECTION HEAD AND LIQUID EJECTION APPARATUS

BACKGROUND OF THE INVENTION

Field of the Invention

The present invention relates to a liquid ejection head and a liquid ejection apparatus.

Description of the Related Art

Japanese Patent Application Laid-Open No. 2008-254362 describes a liquid ejection apparatus in which an electric substrate of a liquid ejection head is provided with a wiring pattern for detecting ink leakage so as to constantly perform the detection of ink leakage when the power of the liquid ejection apparatus is turned on and while the liquid ejection apparatus is in operation.

Regarding the liquid ejection head described in Japanese Patent Application Laid-Open No. 2008-254362, the positional relationship between the electric components of the electric substrate and the wiring pattern for detecting ink leakage is not clearly described. Therefore, in the case of the liquid ejection head described in Japanese Patent Application Laid-Open No. 2008-254362, there are cases where, depending on, for example, the attitude of the liquid ejection head installed in the main unit of a liquid ejection apparatus, ink comes in contact with an electric component before ink leakage is detected by the wiring pattern for detecting ink leakage.

An object of the present invention is to provide a liquid ejection head capable of detecting the leakage of a liquid before the liquid comes in contact with an electric component regardless of the attitude of the liquid ejection head installed in the main unit of a liquid ejection apparatus.

SUMMARY OF THE INVENTION

A liquid ejection head in accordance with the present invention includes:

a recording element substrate which ejects a liquid downward;

an electric substrate which is disposed above the recording element substrate, which has a plurality of electric components, including a capacitor, and which is electrically connected to the recording element substrate;

a wall which covers the electric substrate such that a liquid can be retained between the wall and the electric substrate; and a sensor which is disposed in an area covered by the wall and which detects for the presence of a liquid, wherein, in an attitude of the liquid ejection head as attached to a main unit of a liquid ejection apparatus, the sensor is disposed below the capacitor in a vertical direction.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

<First Embodiment>

Figure 1:
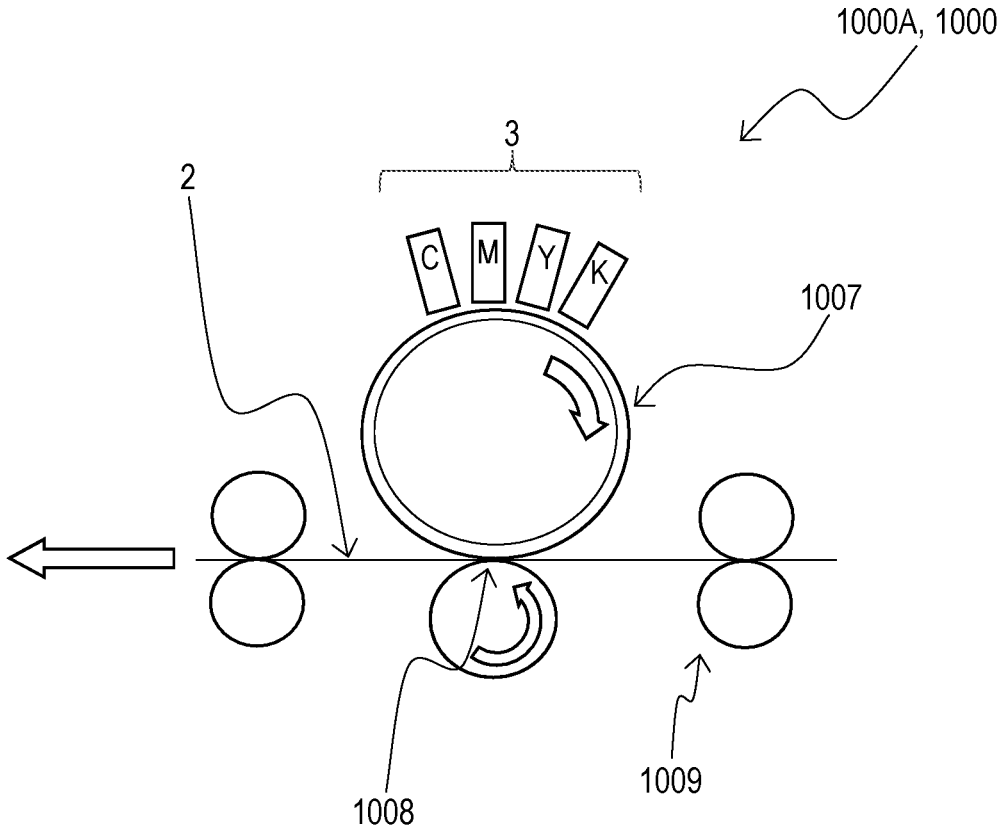
FIG. 1 is a schematic diagram illustrating a liquid ejection apparatus of a first embodiment.

First, a description will be given of the overall configuration of a liquid ejection apparatus 1000 according to the present embodiment. FIG. 1 is a schematic diagram of the liquid ejection apparatus 1000 according to the present embodiment. The liquid ejection apparatus 1000 is adapted to first eject ink I, which is an example of a liquid, onto a transfer drum 1007 (refer to FIG. 1) rather than directly recording from a liquid ejection head 3 onto a recording medium 2. After ink I is attached to (after an image is formed on) the transfer drum 1007, the image is transferred onto the recording medium 2.

In the liquid ejection apparatus 1000, four single-color liquid ejection heads 3 corresponding to four types, namely, CMYK, of ink I are arranged in an arc-like manner along the outer circumference of the transfer drum 1007. With this arrangement, a full-color image is formed on the transfer drum 1007. After being properly dried on the transfer drum 1007, the full-color image is transferred by a transfer section 1008 onto the recording medium 2 fed by a paper feeding roller 1009.

An electric controller, which transmits power and ejection control signals to the liquid ejection heads 3, is electrically connected to the liquid ejection heads 3.

The present embodiment is a type in which ink I is circulated between a tank (not illustrated) and an ejection module 200. However, a different type may be used. For example, rather than circulating ink I, two tanks (not illustrated) may be provided on the upstream side and the downstream side of the liquid ejection heads 3, and ink I may be moved from one tank to the other tank so as to move ink I in a pressure chamber.

Further, the liquid ejection heads 3 of the present embodiment are page-wide heads, which have lengths corresponding to the width of the recording medium 2. However, the present invention may be applied to serial type liquid ejection head 3 adapted to perform recording by scanning the recording medium 2. The serial type liquid ejection head 3 may be configured to have, for example, a recording element substrate for a black ink and a recording element substrate for color inks. However, the configuration is not limited to the above, and shorter line heads may be used, in which a plurality of recording element substrates are disposed such that their ejection orifices are overlapped in the column direction of the ejection orifices, and which are shorter than the width of the recording medium 2. The recording medium 2 used in the present embodiment is not limited to cut paper, and may alternatively be continuous roll paper. An example of the liquid may be a liquid other than ink. Further, the liquid ejection head, which ejects a liquid such as ink, and a liquid ejection apparatus provided with the liquid ejection head in accordance with the present invention can be applied to an apparatus such as a printer, a copier, a facsimile machine having a communication system, or a word processor having a printer unit. In addition, the liquid ejection head and the liquid ejection apparatus in accordance with the present invention can be applied to an industrial recording apparatus compositely combined with various types of processing devices. The liquid ejection head and the liquid ejection apparatus in accordance with the present invention can find applications in the fields of biochip fabrication, electronic circuit printing, semiconductor substrate fabrication, 3D printer and the like.

Figure 2A:
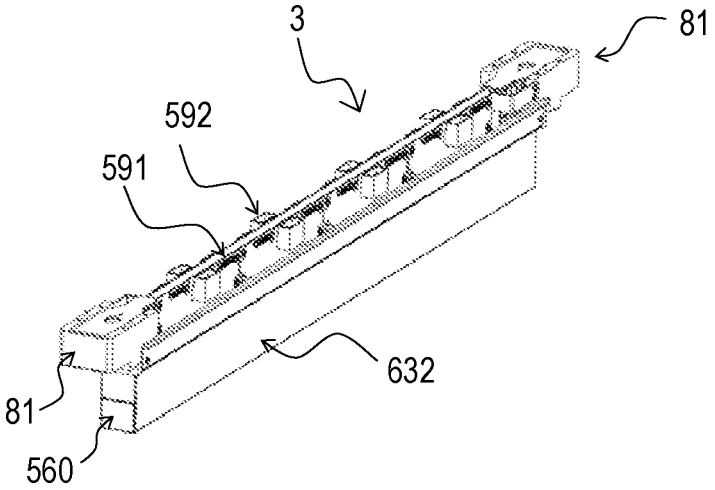
FIGS. 2A and 2B present a perspective view and an exploded perspective view of a liquid ejection head of the first embodiment.

A description will now be given of the liquid ejection head 3 of the present embodiment. FIG. 2A is a perspective view of the liquid ejection head 3, and FIG. 2B is an exploded perspective view of the liquid ejection head 3.

The liquid ejection head 3 is an inkjet page-wide recording head which has a plurality of (e.g. thirty-six) recording element substrates 510 arranged linearly (in line) in the longitudinal direction thereof to perform recording by an ink of each color.

The liquid ejection head 3 includes the ejection module 200, a flow passage assembly 300, an electric component assembly 400, and sensors 597 which detect for the presence of ink I (refer to FIG. 2B and FIG. 3 to FIG. 5). The liquid ejection head 3 further includes a pair of shield plates 632, a pair of unit support sections 81, and liquid supply units 220 (refer to FIG. 2A and FIG. 2B).

Figure 2B:
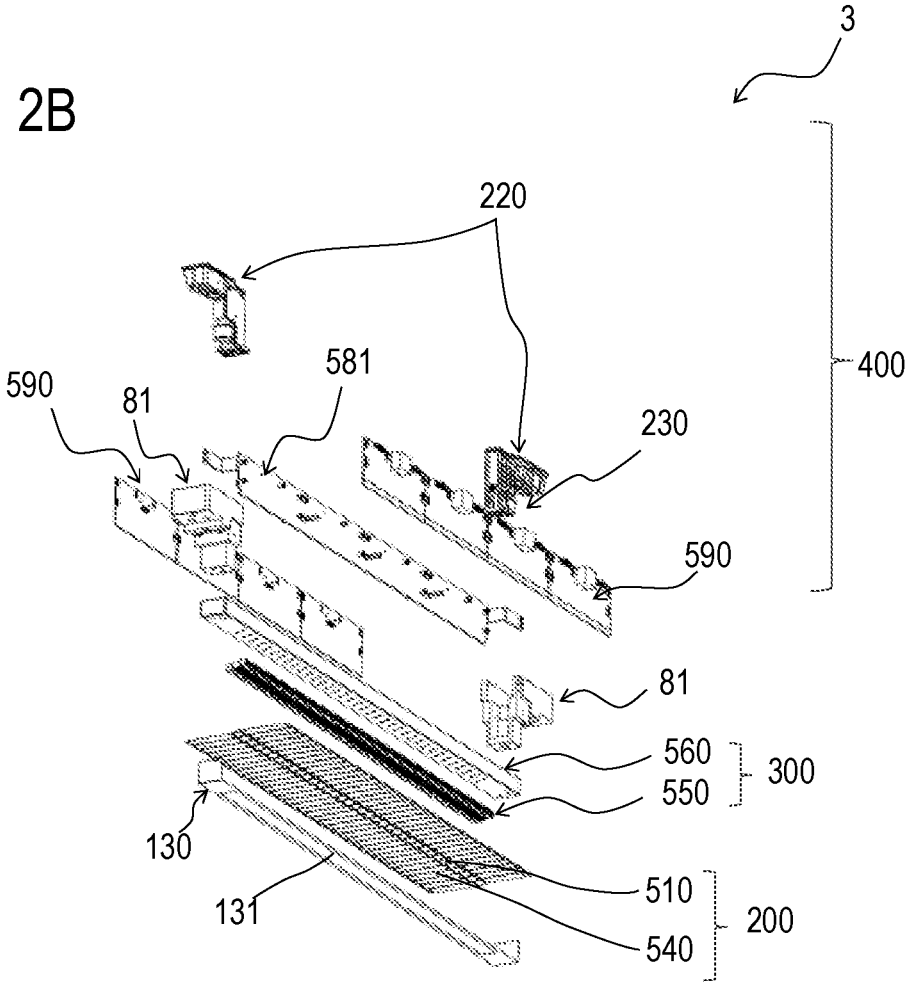
Figure 3:
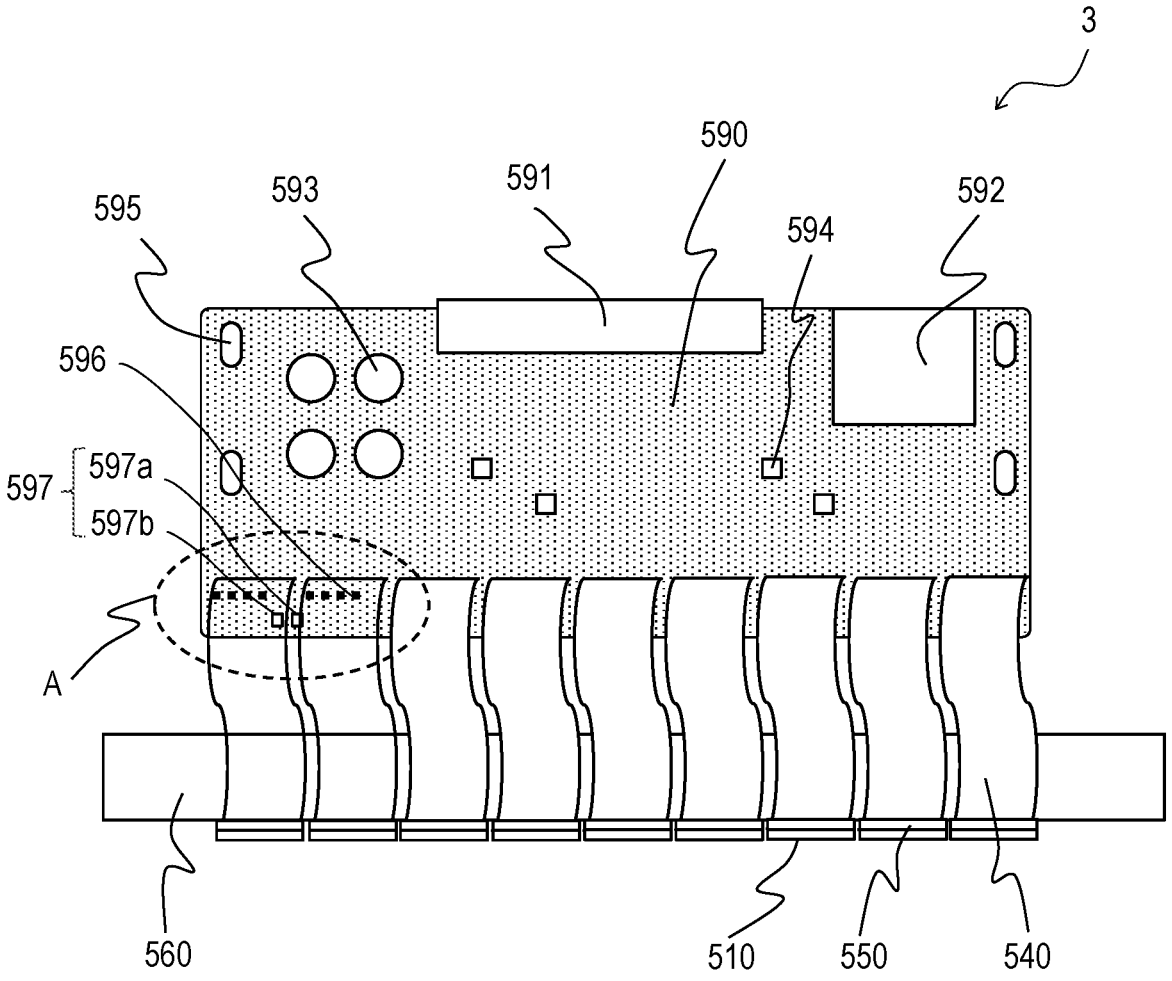
FIG. 3 is a pattern diagram illustrating a part of the liquid ejection head of the first embodiment.
Figure 5:
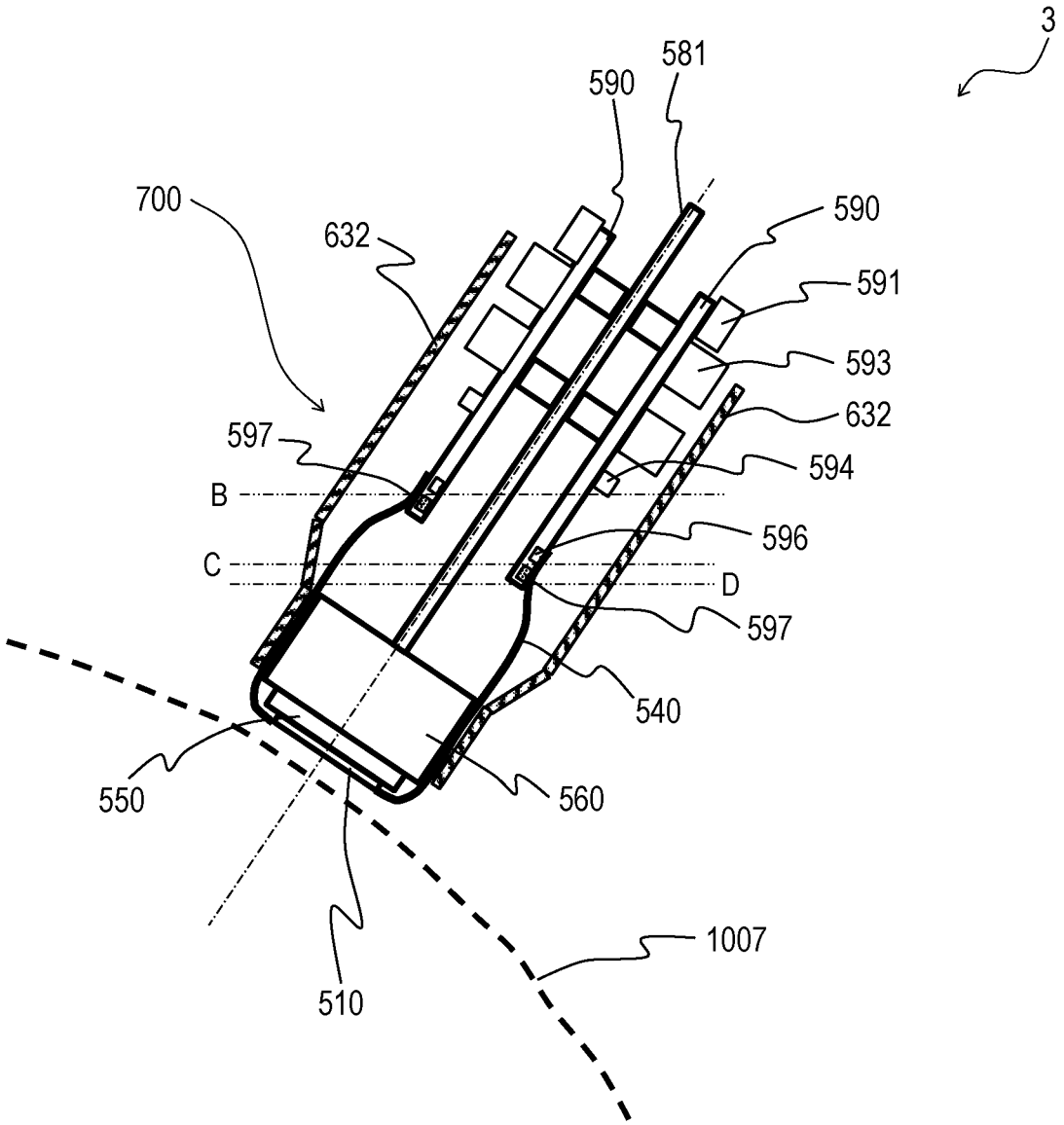
FIG. 5 is a cross-sectional view of the liquid ejection head of the first embodiment.

The ejection module 200 is configured by including a plurality of recording element substrates 510, flexible substrates 540 (e.g. electric wiring substrates) connected to the opposing edges of the recording element substrates 510, and a covering member 130 (refer to FIG. 2B, FIG. 3 and FIG. 5). Formed in the covering member 130 is an opening 131 for exposing the ejection orifice forming surfaces of the recording element substrates 510. The flow passage assembly 300 is configured by including a plurality of first flow passage members 550 and a lengthy second flow passage member 560 (refer to FIG. 2B). The electric component assembly 400 is configured by including a plurality of (e.g. eight) electric substrates 590, a lengthy support plate 581, and a negative pressure control unit 230 (refer to FIG. 2A, FIG. 2B and FIG. 5).

In the present embodiment, the eight electric substrates 590 are attached, four each, to the surfaces of the lengthy support plate 581 attached to the pair of unit support sections 81 (refer to FIG. 2B). The pair of shield plates 632 are placed on a further outer side than the plurality of electric substrates 590 attached to both surfaces of the support plate 581. The pair of the unit support sections 81 are attached to both ends in the longitudinal direction of the pair of shield plates 632, and the second flow passage member 560 is attached to the lower side of the pair of shield plates 632. Further, the pair of shield plates 632, the pair of unit support sections 81, and the second flow passage member 560 constitute a wall 700, which liquid-tightly surrounds the plurality of electric substrates 590 (such that ink I can be retained therein) (refer to FIG. 2B and FIG. 5). In other words, the wall 700 covers the plurality of electric substrates 590 while making it possible to hold ink I between the wall 700 and the plurality of electric substrates 590. The wall 700 is for protecting the electric substrates 590 disposed on the inner side thereof from static electricity, dust, moisture and the like.

FIG. 3 is a pattern diagram illustrating a part of the liquid ejection head 3. The liquid ejection head 3 of the present embodiment has the plurality of ejection modules 200 (the plurality of recording element substrates 510) for a printing width, which are linearly arranged. In other words, the plurality of recording element substrates 510 are arranged in the linear direction to constitute a lengthy substrate group. The ejection modules 200 are electrically connected to the electric substrates 590 through the flexible substrates 540. A plurality of ejection orifices (not illustrated) for ejecting ink I are formed in each of the recording element substrates 510, and each of the recording element substrates 510 ejects ink I through the plurality of ejections ports, which are directed downward. In other words, according to the liquid ejection head 3 of the present embodiment, the recording element substrates 510 are disposed with the ejection orifice surfaces thereof directed downward. Each of the recording element substrates 510 has the ejection orifices for ink I, which are arranged from one end to the other end in the longitudinal direction of the recording element substrate 510, and includes a recording element (not illustrated) which generates energy for ejecting ink I and a pressure chamber (not illustrated) which incorporates the recording element therein. Further, according to the present embodiment, ink I inside the pressure chamber is circulated between the inside of the pressure chamber and the outside thereof (e.g. a tank).

Disposed on each of the electric substrates 590 are capacitors 593, connectors (a signal input terminal 591 and a power supply terminal 592), and electric components 594 such as an EEPROM, a transistor, a power MOSFET, and a chip resistor. Each of the electric substrates 590 generates and outputs a signal for ejecting the ink I on the basis of an operation signal received from a liquid ejection apparatus main unit 1000A through the signal input terminal 591. As illustrated in FIG. 3, the plurality of flexible substrates 540 are connected to each of the electric substrates 590, and each of the recording element substrates 510 is connected to a corresponding one of the flexible substrates 540. Each of the flexible substrates 540 transmits a signal output from a corresponding one of the electric substrates 590 to a corresponding one of the recording element substrates 510. In other words, the plurality of recording element substrates 510 and the electric substrates 590 are connected by the flexible substrates 540.

The plurality of first flow passage members 550 are individually joined to the recording element substrates 510 at the upper side of the recording element substrates 510. The first flow passage members 550, which are arranged along the longitudinal direction of the second flow passage members 560 disposed on the upper side of the first flow passage members 550, are joined to the second flow passage members 560. The flexible substrates 540 are connected to the electric substrates 590 by, for example, wire bonding. The first and the second flexible substrates 540 from the left in FIG. 3 are illustrated in a see-through manner in order to describe the configuration of a part below these two flexible substrates 540 (i.e. the part where the flexible substrates 540 overlap the electric substrate 590). A portion of the electric substrate 590, which portion is connected to the flexible substrates 540, will be referred to as a connection portion 596.

Referring to FIG. 3, the electric substrate 590 is disposed above the recording element substrates 510. Further, the capacitors 593, the connectors (the signal input terminal 591 and the power supply terminal 592), and the electric components 594 are positioned above the connection portions 596. This means that the plurality of electric components (preferably all the electric components) of the electric substrate 590 are positioned above the connection portions 596.

Figure 4A:
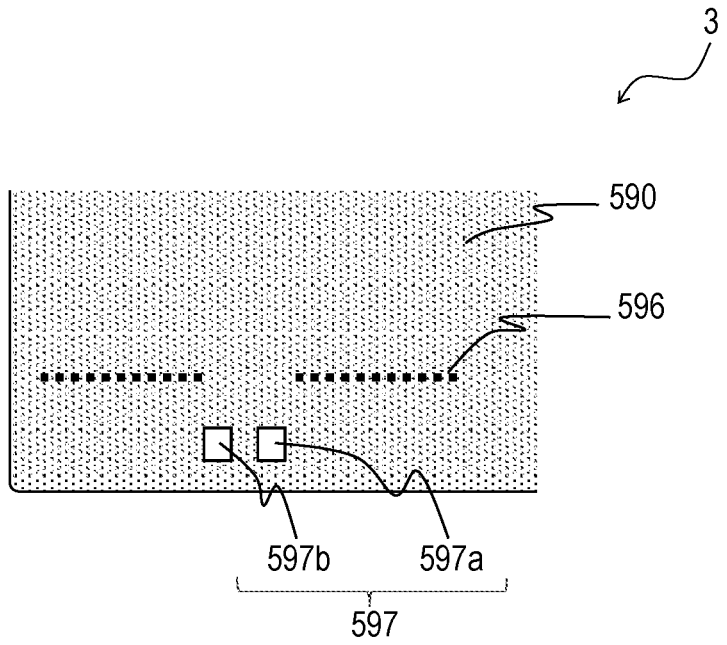
FIGS. 4A and 4B present enlarged views of section A of FIG. 3.
Figure 4B:
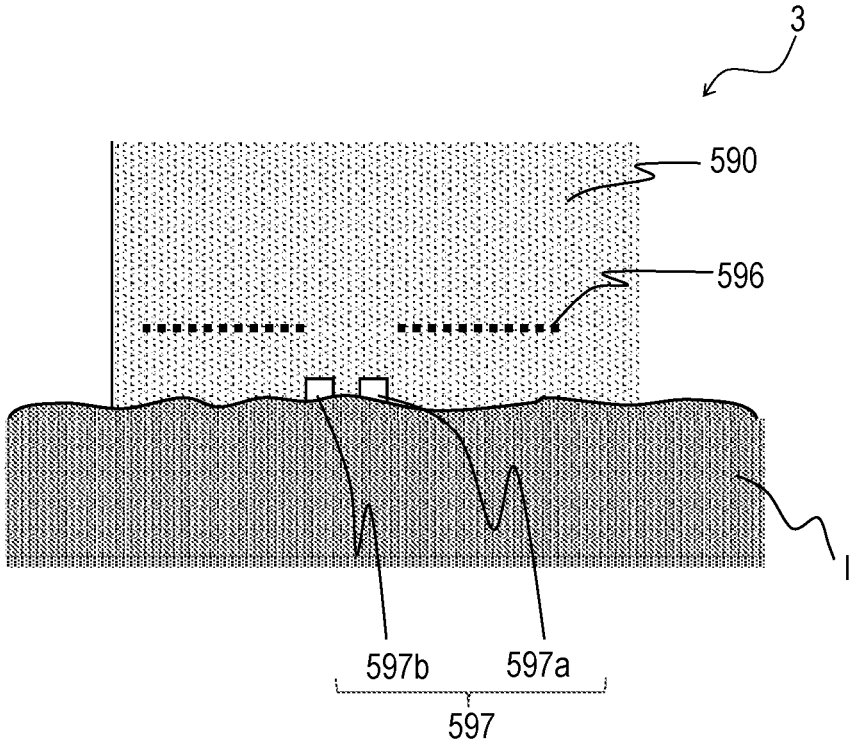

FIG. 4A and FIG. 4B are the enlarged views of portion A enclosed by the dashed line in FIG. 3. In the electric substrate 590, a sensor 597 is provided at a portion below the connection portion 596 connected to the flexible substrates 540. In other words, the sensor 597 is disposed inside the wall 700. The sensor 597 is composed of a pair of detectors 597*a* and 597*b*. The pair of detectors 597*a* and 597*b* are disposed with a distance provided therebetween in the longitudinal direction of the electric substrate 590. The sensor 597 is capable of detecting the presence of ink I by conduction based on the electrical conductivity of ink I in the case where ink I reaches a point between the pair of detectors 597*a* and 597*b* (refer to FIG. 4B).

FIG. 5 is a cross-sectional view of the liquid ejection head 3 (e.g., the liquid ejection head 3 of a color K in FIG. 1), which is a sectional view in the longitudinal direction of the liquid ejection head 3 (the section that intersects with the direction in which the ejection modules 200 are arranged). Referring to FIG. 5, one end of each flexible substrate 540 is connected to one of the sides of the recording element substrate 510, and the other end of each flexible substrate 540 is connected to the connection portions 596 of the electric substrate 590. Further, the electric substrates 590 are fixed by screws or the like to both surface sides of the support plate 581, which is supported by the second flow passage member 560, and are disposed, for example, perpendicularly with respect to the recording element substrates 510.

As illustrated in FIG. 5, in the attitude of the liquid ejection head 3 as installed in the liquid ejection apparatus main unit 1000A, the sensors 597 are disposed below, in the vertical direction, the plurality of electric components (preferably all of the electric components) of the electric substrates 590 and the connection portions 596.

If the leakage of ink I takes place on the inner side of the shield plates 632 of the liquid ejection head 3 (the inner side referring to the area covered by the wall 700, and also referring to the inside of the wall 700 in the present specification), then ink I remains inside the wall 700 rather than leaking out of the wall 700. Then, if ink I accumulates, causing the liquid level of ink I to rise, ink I comes in contact with the capacitors 593, the connectors (the signal input terminal 591 and the power supply terminal 592), the electric components 594 and the connection portions 596, resulting in the occurrence of a failure such as a short circuit.

According to the present embodiment, therefore, the attitudes of the liquid ejection heads 3 attached to the liquid ejection apparatus main unit 1000A are such that the sensors 597 are disposed below, in the vertical direction, all the electric components and the connection portions 596 of the electric substrates 590 (refer to FIG. 5). More specifically, position B in the vertical direction in FIG. 5 denotes the position of an electric component disposed at the lowest position among all the electric components of one of the opposing electric substrates 590 that is disposed on the lower side in the vertical direction. Further, position C denotes the position where the connection portion 596 is provided, and position D denotes the position where the sensor 597 is disposed. Further, even if the liquid ejection head 3 is placed aslant, position D is below, in the vertical direction, position B and position C. Thus, the sensor 597 will detect ink I before the liquid level of ink I reaches the capacitor 593, the connectors (the signal input terminal 591 and the power supply terminal 592), the electric component 594 and the connection portion 596. In the present embodiment, an arrangement may be made such that, for example, when the sensor 597 detects that ink I has reached the foregoing liquid level, an alarm means (e.g. a panel for alarming a user) is actuated to notify a user to that effect and urge the user to replace the liquid ejection head 3.

As described above, the present embodiment provides the following effects.

The sensors 597 in the present embodiment are placed at the positions that are lower in the vertical direction than those of all electric components. According to the present embodiment, therefore, ink I can be detected before ink I that has leaked into the wall 700 comes in contact with the electric component disposed at the lowest level in the vertical direction among all the electric components.

The sensors 597 in the present embodiment are placed at the positions that are lower in the vertical direction than those of at least the capacitors 593 among all the electric components. Therefore, according to the present embodiment, ink I can be detected before ink I that has leaked into the wall 700 comes in contact with at least the capacitors 593. If the capacitors 593 come in contact with ink I, then the capacitors 593 will exert greater influences than those of other electric components. Hence, placing at least the capacitors 593 at the positions that are higher in the vertical direction than those of the sensors 597 is effective.

Although placing the sensors 597 at positions that are lower in the vertical direction than those of all the electric components is effective, an electric component that will exert relatively less influence in case of contact with ink I among the electric components may be provided below the sensors 597.

The sensors 597 of the present embodiment are positioned below the connection portions 596 in the vertical direction. Thus, according to the present embodiment, ink I can be detected before ink I that has leaked into the wall 700 comes in contact with the connection portions 596.

The sensors 597 of the present embodiment are provided on the electric substrates 590. Thus, the sensors 597 can be provided with a simple configuration.

In order to advance the timing for detecting ink I in the wall 700, a member (liquid absorber), for example, which is composed of a porous body or the like to absorb ink I may be disposed in the wall 700 and below the sensors 597. This modification example can quickly detect the leakage of ink I into the wall 700, as compared with one that has no liquid absorber.

In the present embodiment, there is a possibility of, for example, the leakage of ink I in the process of supplying ink I from a liquid supply unit 220 to the second flow passage member 560. More specifically, there is a concern that ink I leaks at both ends in the longitudinal direction of the liquid ejection head 3. If the leakage of ink I occurs, then the ink I tends to accumulate between the electric substrate 590 of the opposing electric substrates 590 that is disposed at a lower level and the shield plate 632 that opposes the electric substrate 590 in the case where the liquid ejection head 3 is placed aslant as in the present embodiment (FIG. 5). For this reason, the sensor 597 is preferably provided at least on the electric substrate 590 of the opposing electric substrates 590 that is disposed at the lower level.

<Second Embodiment>

Figure 6:
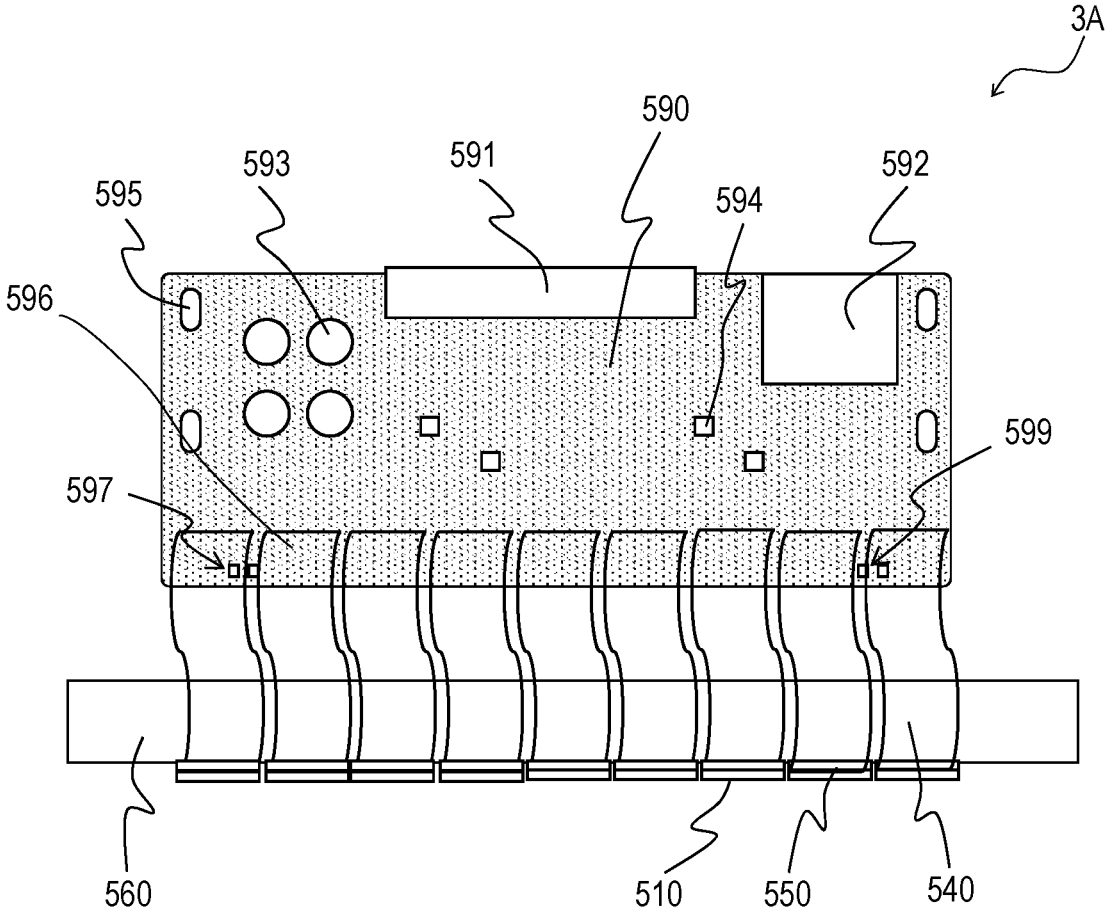
FIG. 6 is a pattern diagram illustrating a part of a liquid ejection head of a second embodiment.

A second embodiment will now be described. Regarding the present embodiment, only the aspects that are different from those of the first embodiment will be described. FIG. 6 is a pattern diagram illustrating a part of a liquid ejection head 3A according to the present embodiment. In the present embodiment, a sensor 597 and a sensor 599 are disposed at both ends in the longitudinal direction of each electric substrate 590. The sensor 599 has the same configuration as that of the sensor 597. More specifically, the two sensors, namely, the sensor 597 and the sensor 599, are positioned apart from each other in the longitudinal direction of a plurality of recording element substrates 510 (a substrate group) in the present embodiment.

Figure 7A:
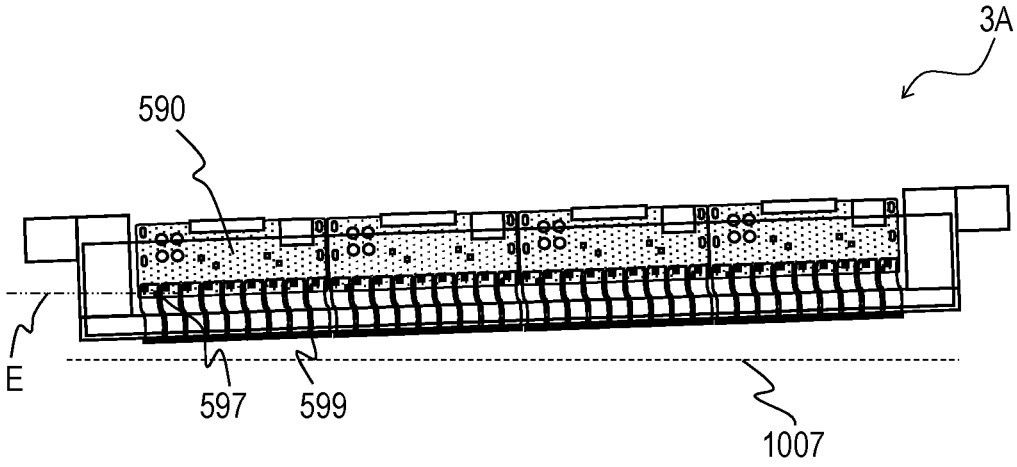
FIGS. 7A and 7B present pattern diagrams illustrating an example of the state in which the liquid ejection head of the second embodiment has been installed.
Figure 7B:
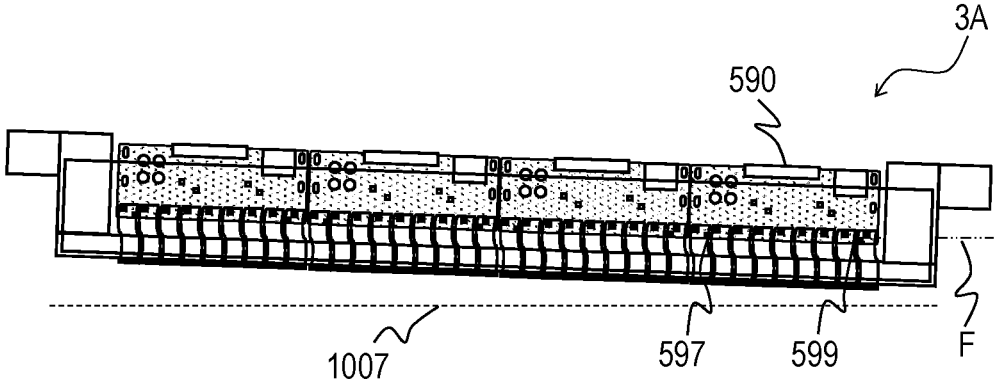

FIG. 7A and FIG. 7B illustrate the attitude in the longitudinal direction of the liquid ejection head 3A attached to a liquid ejection apparatus main unit 1000A. It is assumed that, when the liquid ejection head 3A is mounted on the liquid ejection apparatus main unit 1000A, the liquid ejection head 3A is inclined as illustrated in FIG. 7A and FIG. 7B due to the component accuracies, such as the machining tolerances or manufacturing tolerances of members, and the installation place or the like of a liquid ejection apparatus 1000.

According to the liquid ejection head 3A of the present embodiment, even if the liquid ejection head 3A is inclined in the longitudinal direction as illustrated in FIG. 7A and FIG. 7B, ink I can be detected when the liquid level of ink I inside a wall 700 reaches at least one of position E and position F. Position E and position F are the positions in the vertical direction of the sensor 597 or the sensor 599 whichever is placed below the other, depending upon the inclined attitude in the longitudinal direction of the liquid ejection head 3A.

With the configuration described above, the liquid ejection head 3A according to the present embodiment ensures high accuracy of detection of ink I even if the liquid ejection head 3A is inclined in the longitudinal direction.

<Third Embodiment>

Figure 8:
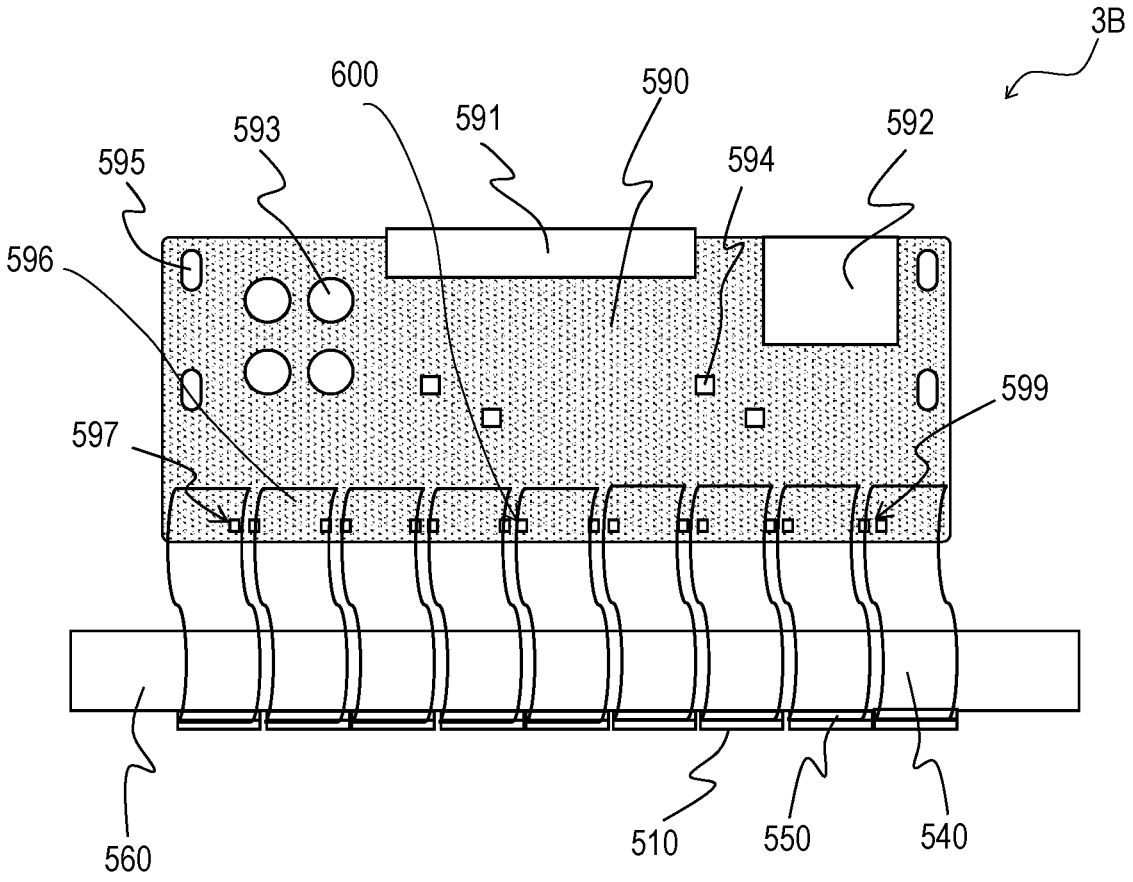
FIG. 8 is a pattern diagram illustrating a part of a liquid ejection head of a third embodiment.

A third embodiment will now be described. Regarding the present embodiment, only the aspects that are different from those of the first and the second embodiments will be described. FIG. 8 is a pattern diagram illustrating a part of a liquid ejection head 3B according to the present embodiment.

In the present embodiment, three or more sensors, namely, sensors 597, sensors 599 and sensors 600, are disposed on each electric substrate 590 along the longitudinal direction thereof. The sensors 600 have the same configurations as those of the sensors 597. More specifically, in the present embodiment, the plurality of sensors, namely, the sensors 597, 599 and 600, are arranged along the longitudinal direction of each recording element substrate 510. In other words, the plurality of sensors, namely, the sensors 597, 599 and 600, are arranged along the longitudinal direction of the plurality of recording element substrates 510 (a substrate group).

Figure 9:
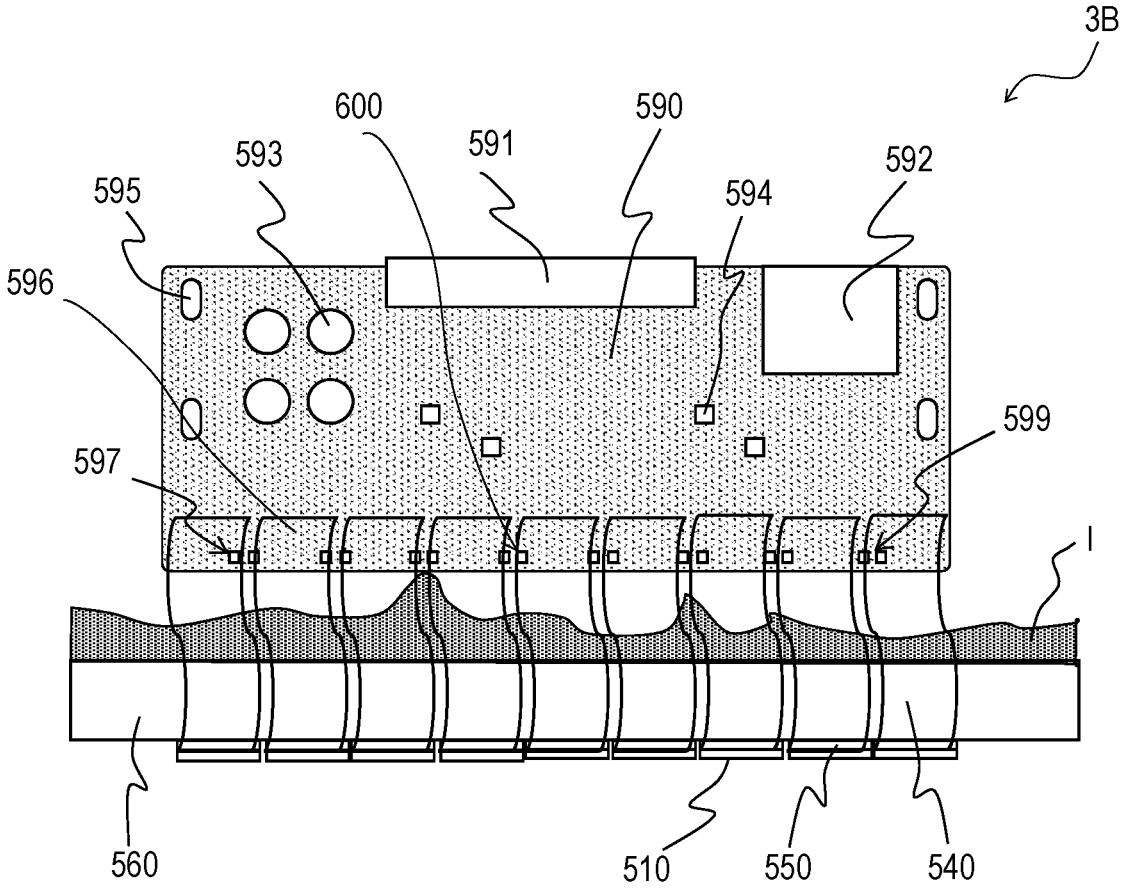
FIG. 9 is a pattern diagram illustrating the relationship between the liquid ejection head of the third embodiment and an ink that has leaked.

FIG. 9 illustrates a case where the liquid level of ink I leaked into a wall 700 is not even, as in a case where, for example, a part of ink I flows along an edge of a flexible substrate 540 or through the gap between adjacent flexible substrates 540, causing the liquid level thereof to quickly rise.

With the configuration described above, the liquid ejection head 3B according to the present embodiment ensures high accuracy of detection of the leakage of ink I, as compared with the liquid ejection head 3 according to the first embodiment described above, even if the liquid level of ink I leaked into the wall 700 is not uniform as illustrated in FIG. 9.

Thus, the present invention has been described, using the foregoing embodiments as examples. However, the technological scope of the present invention is not limited to the embodiments.

For example, in the present embodiments, a thermal type, in which air bubbles are generated by heating elements to eject ink, has been adopted as an example. The present invention, however, can be applied also to liquid ejection heads that adopt various other types of liquid ejection methods, including a piezoelectric type The liquid ejection head in accordance with the present invention makes it possible to detect the leakage of a liquid before the liquid comes in contact with an electric component, regardless of the attitude of the liquid ejection head attached to the main unit of a liquid ejection apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-137266, filed Jul. 13, 2017, which is hereby incorporated by reference herein in its entirety.

What is claimed is:

1. A liquid ejection head comprising:

a recording element substrate which ejects a liquid;

an electric wiring substrate which is electrically connected to the recording element substrate;

an electric substrate which has a capacitor, which is electrically connected to the recording element substrate via the electric wiring substrate, and which is provided with a connection portion electrically connected to the electric wiring substrate;

a wall which covers the electric substrate such that a liquid can be retained between the wall and the electric substrate; and a sensor which is disposed in an area covered by the wall and which detects for the presence of a liquid, wherein, in an attitude of the liquid ejection head as attached to a main unit of a liquid ejection apparatus, the sensor is disposed below the capacitor and the connection portion in a vertical direction.

2. The liquid ejection head according to claim 1, wherein the recording element substrate is provided plural in number, and the plurality of recording element substrates are arranged along a linear direction, the plurality of recording element substrates constitute a substrate group, and the sensor is provided plural in number and the plurality of sensors are arranged along a longitudinal direction of the substrate group.

3. The liquid ejection head according to claim 2, wherein a plurality of the electric substrates are arranged along the longitudinal direction, and the sensors are provided on each of the plurality of electric substrates.

4. The liquid ejection head according to claim 1, wherein the recording element substrate is provided plural in number, and the plurality of recording element substrates are arranged along a linear direction, the plurality of recording element substrates constitute a substrate group, and at least two sensors are provided, and the sensors are positioned apart from each other in a longitudinal direction of the substrate group.

5. The liquid ejection head according to claim 1, wherein the sensor is provided on the electric substrate.

6. The liquid ejection head according to claim 1, wherein the wall includes a shield plate for protecting the capacitor.

7. The liquid ejection head according to claim 1, further comprising:

a liquid absorber which is disposed in an area covered by the wall and below the sensor and which absorbs a liquid inside the area.

8. The liquid ejection head according to claim 1, further comprising:

a pressure chamber having therein a recording element, which generates energy, wherein a liquid inside the pressure chamber is circulated between inside and outside of the pressure chamber.

9. A liquid ejection apparatus comprising:

the liquid ejection head according to claim 1; and the main unit which supports the liquid ejection head such that the liquid ejection head is set at an attitude for ejecting the liquid downward.

10. The liquid ejection apparatus according to claim 9, wherein the main unit supports the liquid ejection head such that an ejection orifice surface of the recording element substrate through which the liquid is ejected is inclined with respect to the vertical direction.

11. A liquid ejection head comprising:

a recording element substrate which ejects a liquid;

an electric wiring substrate which is electrically connected to the recording element substrate;

an electric substrate which has a plurality of electric components, which is electrically connected to the recording element substrate via the electric wiring substrate, and which is provided with a connection portion electrically connected to the electric wiring substrate;

a wall which covers the electric substrate such that a liquid can be retained between the wall and the electric substrate; and a sensor which is disposed in an area covered by the wall and which detects for the presence of a liquid, wherein, in an attitude of the liquid ejection head as attached to a main unit of a liquid ejection apparatus, the sensor is disposed below the plurality of electric components and the connection portion in a vertical direction.

12. The liquid ejection head according to claim 11, wherein the recording element substrate is provided plural in number, and the plurality of recording element substrates are arranged along a linear direction, the plurality of recording element substrates constitute a substrate group, and the sensor is provided plural in number and the plurality of sensors are arranged along a longitudinal direction of the substrate group.

13. The liquid ejection head according to claim 12, wherein a plurality of the electric substrates are arranged along the longitudinal direction, and the sensors are provided on each of the plurality of electric substrates.

14. The liquid ejection head according to claim 11, wherein the recording element substrate is provided plural in number, and the plurality of recording element substrates are arranged along a linear direction, the plurality of recording element substrates constitute a substrate group, and at least two sensors are provided, and the sensors are positioned apart from each other in a longitudinal direction of the substrate group.

15. The liquid ejection head according to claim 11, wherein the sensor is provided on the electric substrate.

16. A liquid ejection apparatus comprising:

the liquid ejection head according to claim 11; and the main unit which supports the liquid ejection head such that the liquid ejection head is set at an attitude for ejecting the liquid downward.

17. The liquid ejection apparatus according to claim 16, wherein the main unit supports the liquid ejection head such that an ejection orifice surface of the recording element substrate through which the liquid is ejected is inclined with respect to the vertical direction.

18. A liquid ejection head comprising:

a recording element substrate which ejects a liquid;

an electric wiring substrate which is electrically connected to the recording element substrate;

an electric substrate which is electrically connected to the recording element substrate via the electric wiring substrate, and which is provided with a connection portion electrically connected to the electric wiring substrate; and a sensor which is provided on the electric substrate and which detects for the presence of a liquid, wherein, the sensor is disposed at a position near an edge of the electric substrate as compared with a position where the connection portion is disposed with respect to a direction in which the electric wiring substrate is elongated from the connection portion.

19. The liquid ejection head according to claim 18, wherein a plurality of connection portions are provided on the electric substrate, and the sensor is provided at an end of the electric substrate with respect to a direction in which the plurality of the connection portions are provided.

20. The liquid ejection head according to claim 18, wherein a plurality of connection portions and a plurality of sensors are provided on the electric substrate, and the sensors are provided at corresponding ends of the electric substrate in a direction in which the plurality of the connection portions are provided.

21. The liquid ejection head according to claim 18, wherein the connection portion includes a first connection portion and a second connection portion, and the electric wiring substrate includes a first electric wiring substrate and a second electric wiring substrate, the first connection portion, to which the first electric wiring substrate is electrically connected, and the second connection portion, to which the second electric wiring substrate is electrically connected, are provided on the electric substrate, and the sensor is provided at a position between the first connection portion and the second connection portion.

* * * * *